United States Patent [19]

Paquette

[11] Patent Number: 5,060,444

[45] Date of Patent: Oct. 29, 1991

[54] SHINGLE

[76] Inventor: Jean-Paul Paquette, 91, rang des Etangs, St-Jean Baptiste de Rouville, Québec, Canada, J0L 2B0

[21] Appl. No.: 579,611

[22] Filed: Sep. 10, 1990

[51] Int. Cl.[5] ..... E04D 1/26

[52] U.S. Cl. ..... 52/535; 52/526; 52/542; 52/555

[58] Field of Search ..... 52/533, 534, 535, 539, 52/526

[56] References Cited

U.S. PATENT DOCUMENTS

| | | | |
|---|---|---|---|
| 2,002,244 | 8/1931 | Kremper | 52/542 |
| 4,932,184 | 6/1990 | Waller | 52/535 |

*Primary Examiner*—Richard E. Chilcot, Jr.
*Assistant Examiner*—Wynn Wood
*Attorney, Agent, or Firm*—Pierre Lespérance

[57] ABSTRACT

A shingle system for covering sloping roofs and also capable of being used as wall sidings. The shingles are made of heat-insulating material and each main shingle has at its underface a network of intersecting channels communicating with the channels of adjacent shingles for ventilation of the space between the support surface and the shingles, to prevent water condensation. The shingles are laid in cross-rows and longitudinal rows and have keys to interlock adjacent shingles along both rows. The shingles have water barriers at their top face to prevent wind-swept rainwater from entering the joints between adjacent shingles and from overflowing onto the support surface. Concealed passageways are provided to allow this water to run off the shingles. Ridge shingles and side edge shingles are also provided to prevent rain from reaching the support surface, while permitting air circulation between the shingles and the support surface. A fascia board is also provided for the same purpose.

6 Claims, 14 Drawing Sheets

28
48
46
50
10
B
114
110
104
106
112
58
C
111
102
3
34
40
38
92
86
84
80
82
7

28
102
114
10
10
10F
6
5
6
92
5

96
28
92
94
10F
26
28
24

28
98
94
100
92
92

Fig. 36
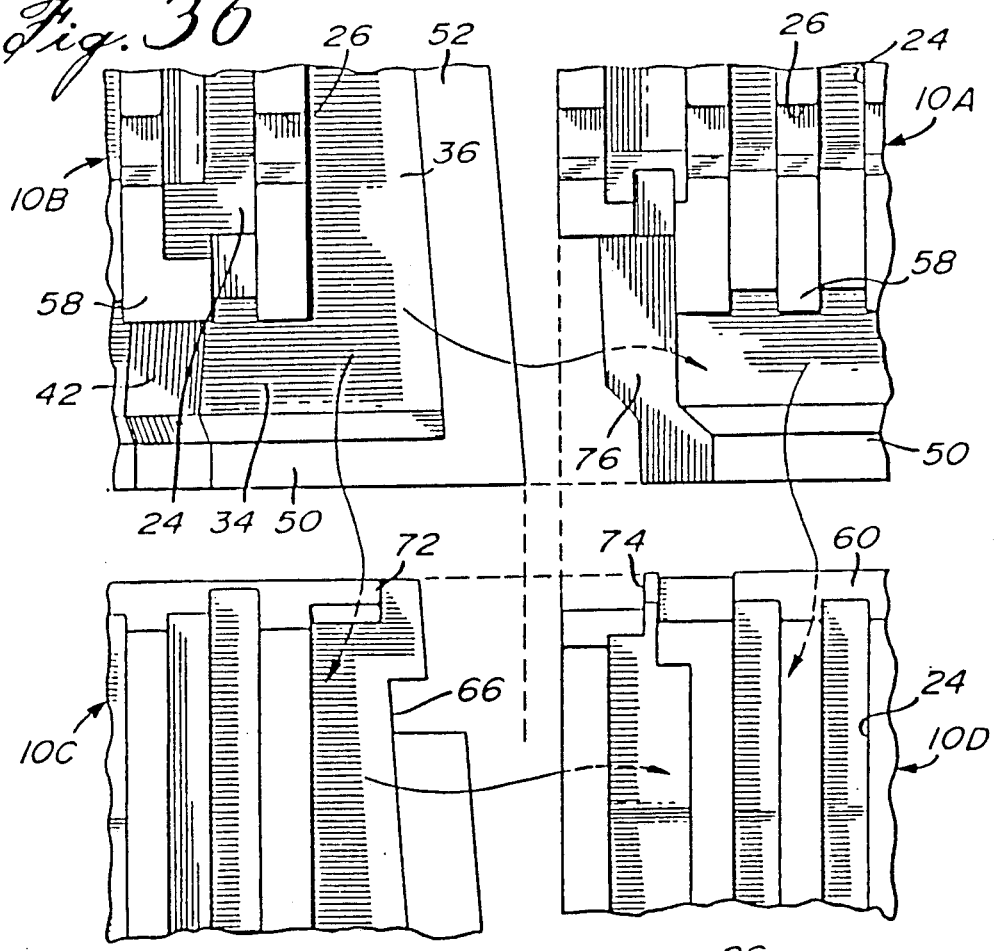
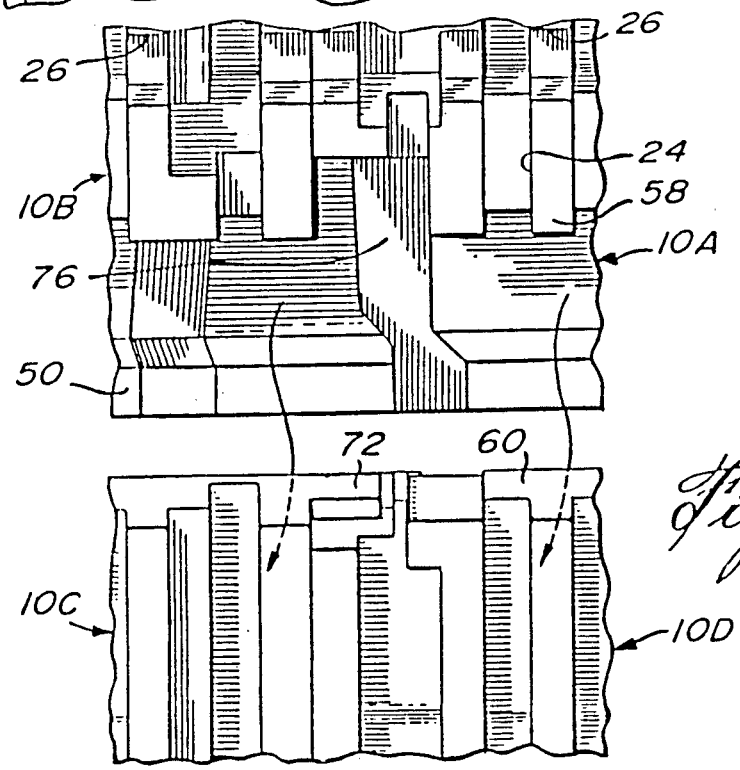
Fig. 37

SHINGLE

FIELD OF THE INVENTION

The present invention relates to heat-insulating shingle to be used as a roofing system and also as wall sidings.

BACKGROUND OF THE INVENTION

Known roofing systems for sloping roofs, such as shingles made of asphalt, terracotta and the like, do not provide ventilation underneath the shingles and it frequently happens in cold climates that humidity from the house condenses underneath the shingles, and there is produced ice formation at the edge of the roof, which blocks water run-off and causes water infiltration. Heating wires to melt the ice must therefore be installed over the shingles. This is unsightly and difficult of upkeep.

The joints between known shingles forming a roof covering are not waterproof, especially under the action of windswept rain and, therefore, there is often water infiltration under high wind condition.

Known heat insulating shingles possess the same disadvantages.

Terracotta tiles, which impart good aesthetics to a roof, are fragile and, therefore, are difficult to handle; are heavy and thus require roof reinforcement and also suffer from ice formation and water infiltration by wind-swept rain.

OBJECTS OF THE INVENTION

It is the general object of the invention to provide shingles which obviate the above-noted disadvantages.

It is a more specific object of the invention to provide a shingle which is heat insulating; which prevents water condensation under the same; which prevents infiltration by windswept rain; and which is light weight and yet strong enough to be walked over.

Another object of the invention is to provide an assembly of shingles in which all the joints are invisible; in which the shingles can be made to imitate terracotta shingles of various designs and which can be very quickly laid on a roof and even on existing worn-out roof covering without having to remove the latter.

SUMMARY OF THE INVENTION

The main shingle of the invention is generally four sided, made of heat-insulating material, such as plastic foam, has a flat underface to flatly rest on a support surface, a top face, a front edge face, a back edge face substantially parallel to the front edge face and left-hand and right-hand side edge faces., the front edge face and the back edge face are adapted to abut the back edge face and the front edge face of adjacent leading and trailing shingles of the same longitudinal row, respectively; the left-hand and right-hand edge faces are adapted to abut a right-hand and a left-hand face of adjacent leading and trailing shingles of the same cross-row. Each shingle is of decreasing thickness in the upward direction of the longitudinal row, with the top face and the underface converging toward the back edge face. The underface has a network of longitudinal and intersecting transverse channels adapted to register with the channels of adjacent shingles, in both longitudinal rows and in cross-rows, to provide ventilation underneath the shingles. Each shingle has interfitting key means at its front and back edge faces to prevent the front portion of a trailing shingle from being lifted off the rear portion of a leading shingle. Each shingle has a front marginal extension of its top face, which overhangs its front edge face. Each shingle has further a lefthand marginal extension of its top face, which overhangs the left-hand edge face and is adapted to overlap a right-hand marginal portion of a leading shingle of the same cross-row. Thus, the shingles form invisible joints. The top face of each shingle is provided with an upstanding peripheral flange forming a water barrier to prevent wind-swept water pushed in the general direction of the ridge of the roof from penetrating the joints of adjacent shingles. Passages are provided underneath the overlapping portions of the shingles and notches are made in the back of said left-hand marginal extensions to interconnect said passages to allow water run-off over the top faces of the shingles. The shingles are shaped to provide at least one rib at their top surface, this rib tapering from front to back of the shingle. Means are provided to automatically align the shingles in cross-rows and in longitudinal rows for easy installation of the same.

Ridge shingles, roof side edge shingles and a fascia strip are also disclosed to complete the roofing system.

BRIEF DESCRIPTION OF THE DRAWINGS

FIGS. 36, 37, and 38 are underface partial plan views of an array of four shingles shown not yet interconnected in FIG. 36, connected two by two in FIG. 37; and three shingles interconnected and one shingle about to be connected in FIG. 38.

DETAILED DESCRIPTION OF THE PREFERRED EMBODIMENTS

Figures 1, 2, 3:
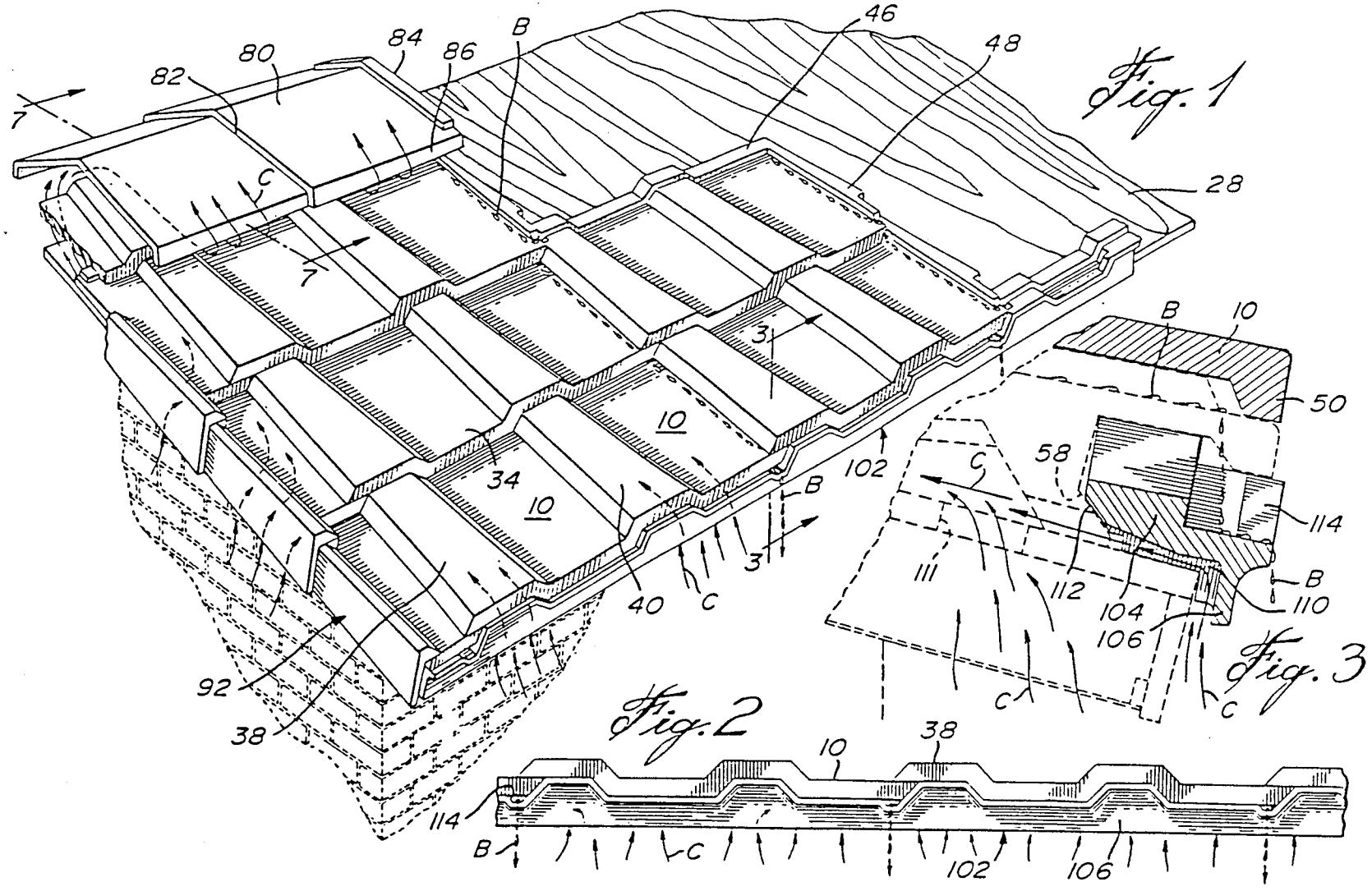
FIG. 1 is a partial perspective view of the left-hand side of a double sloping roof, partially covered with the shingle system of the invention.
FIG. 2 is a partial front end view of the fascia board and overlying main shingles.
FIG. 3 is a partial cross-section taken along line 3—3 of FIG. 1.
Figure 9:
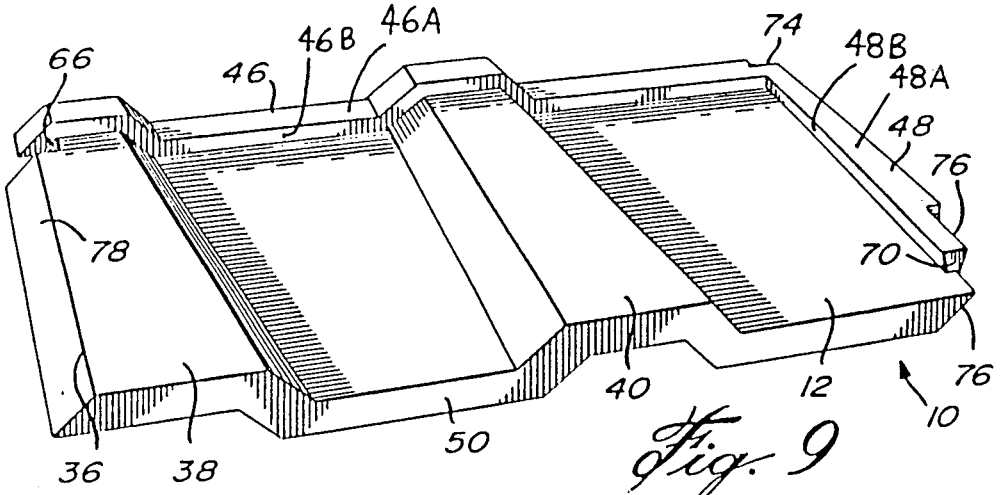
FIG. 9 and FIG. 10 are perspective views looking at the top and at the bottom, respectively, of a main shingle.
Figure 10:
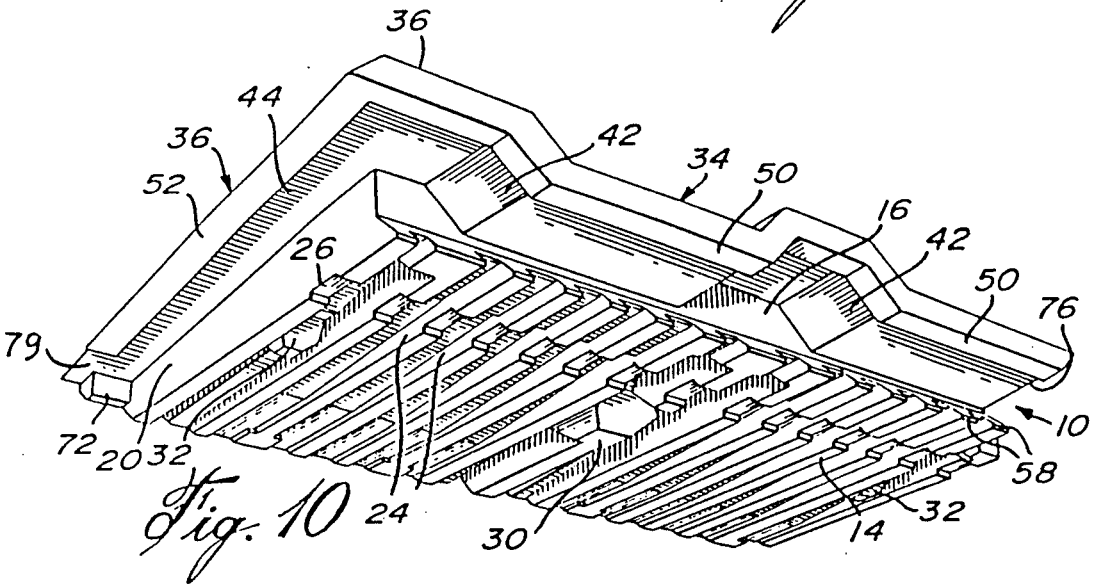
Figure 11:
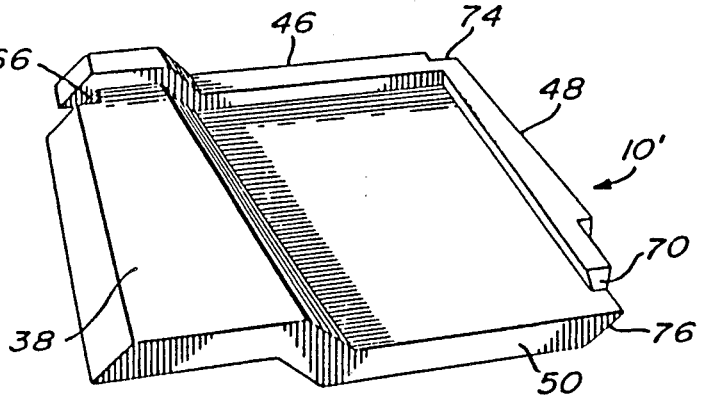
FIG. 11 is a perspective view looking at the top of a second embodiment of the main shingle.
Figure 14:
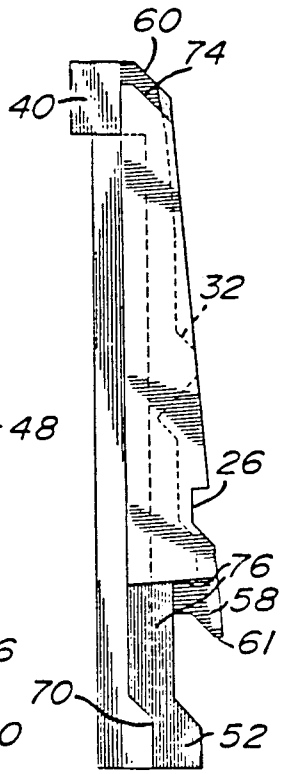
FIG. 13 and FIG. 14 are left-hand side and right-hand side elevations of the same, also taken along lines 13—13 and 14—14 of FIG. 17.

Referring to FIGS. 1 and 9 to 11, there is shown a main shingle 10 with a two-rib formation in FIGS. 1, 9 and 10, and a main shingle 10' with a single-rib formation in FIG. 11. These two types of shingles are basically the same, the shingle of FIG. 11 covering a smaller area.

The description is made in relation with the shingles of FIGS. 9 and 10.

Figure 13:
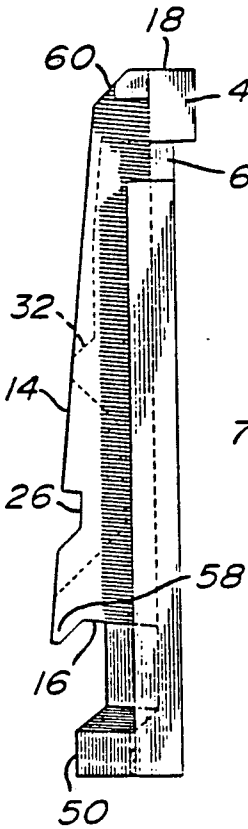
Figure 15:
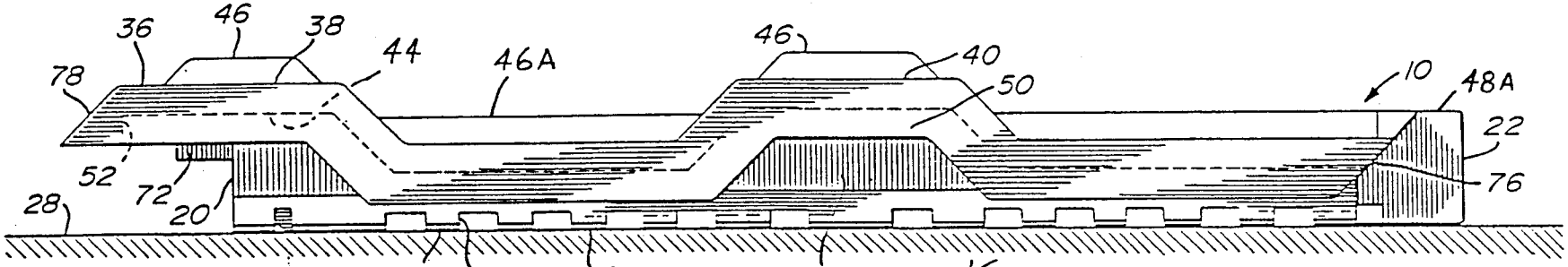
FIG. 15 and FIG. 16 are front end and rear end elevations, respectively, of the main shingle.
Figure 16:
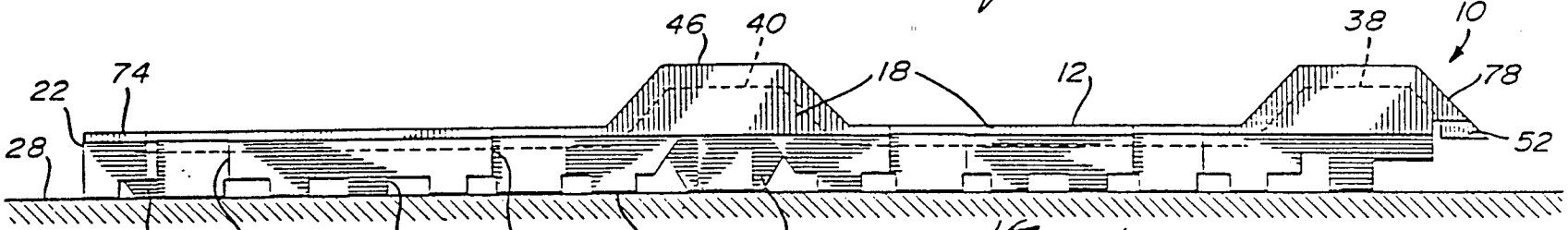

The shingle 10 is a one-piece quadrangular body made of heat-insulating material, such as a plastic foam, preferably high-density polystyrene foam of three to four pounds per cubic foot (3–4 lbs/ft$^3$). Each shingle 10 has a body top face 12, an underface 14, a front edge face 6, a back edge face 18 (see FIG. 13), a left-hand side edge face 20 (see FIG. 10) and a right-hand side edge face 22 (see FIG. 15).

Figures 4, 5, 6:
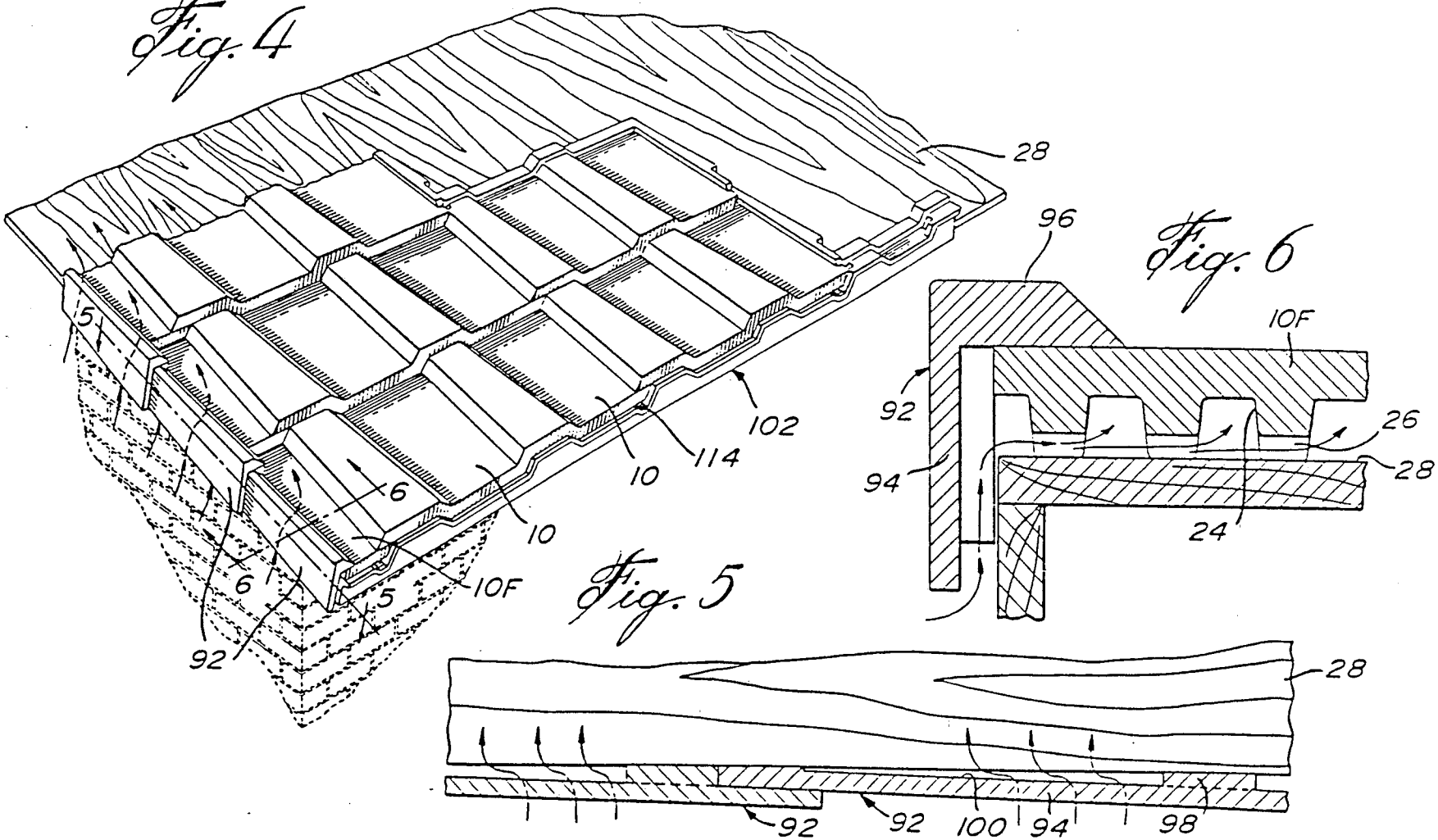
FIG. 4 is a view similar to that of FIG. 1.
FIG. 5 is a partial longitudinal section taken along line 5—5 of FIG. 4.
FIG. 6 is a partial cross-section taken along line 6—6 of FIG. 4.

The shingle is four sided with the edge faces 16 and 18 parallel to each other and the edge faces 20, 22 also parallel to each other. As shown in FIGS. 1 and 4, the shingles 10 are adapted to be laid and interlocked in cross-rows parallel to the fascia of the roof and in longitudinal rows towards the ridge of the roof. In the example shown, the shingles can be successively laid either in cross-rows or in longitudinal rows, starting from the left-hand lower corner of the roof. When laying in crossrows, the left-hand side face 20 of a trailing shingle is adapted to abut against the right-hand side edge 22 of a leading shingle.

Figure 20:
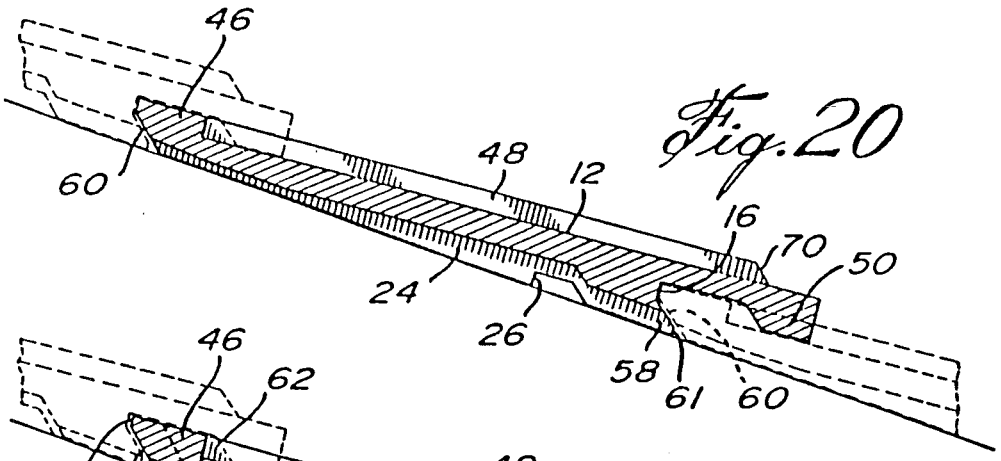
Figure 21:
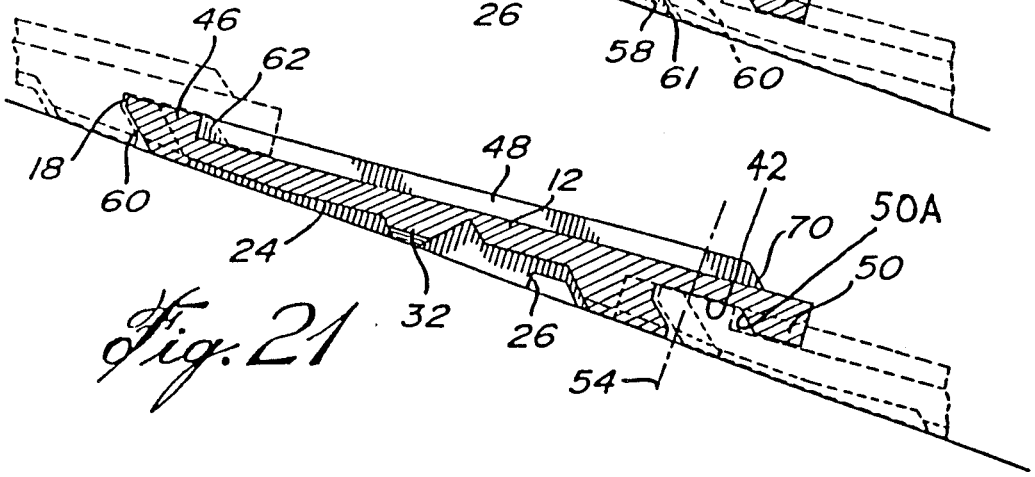
Figure 22:
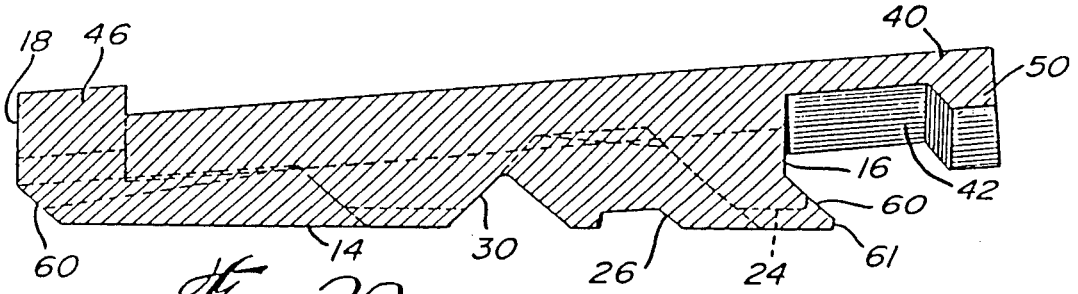
Figure 23:
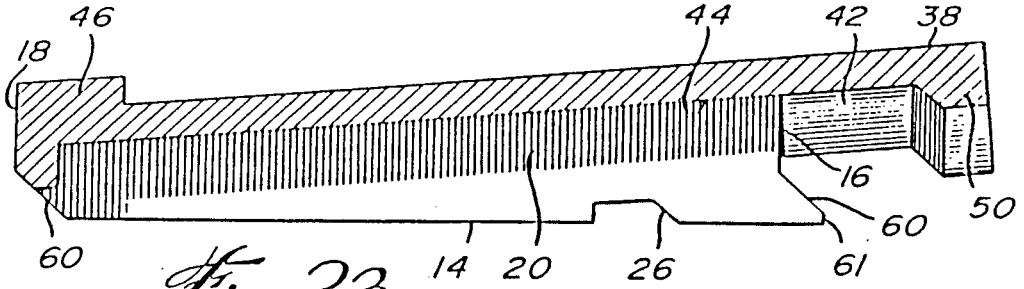
Figure 24:
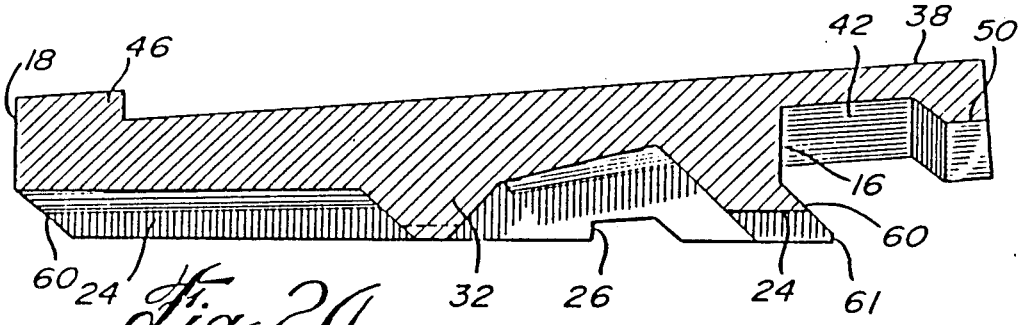

Similarly, the shingles of a longitudinal row abut each other with the back edge face 18 of a leading shingle in contact with the front edge face 16 of a trailing shingle (see FIGS. 20 and 21).

Figure 17:
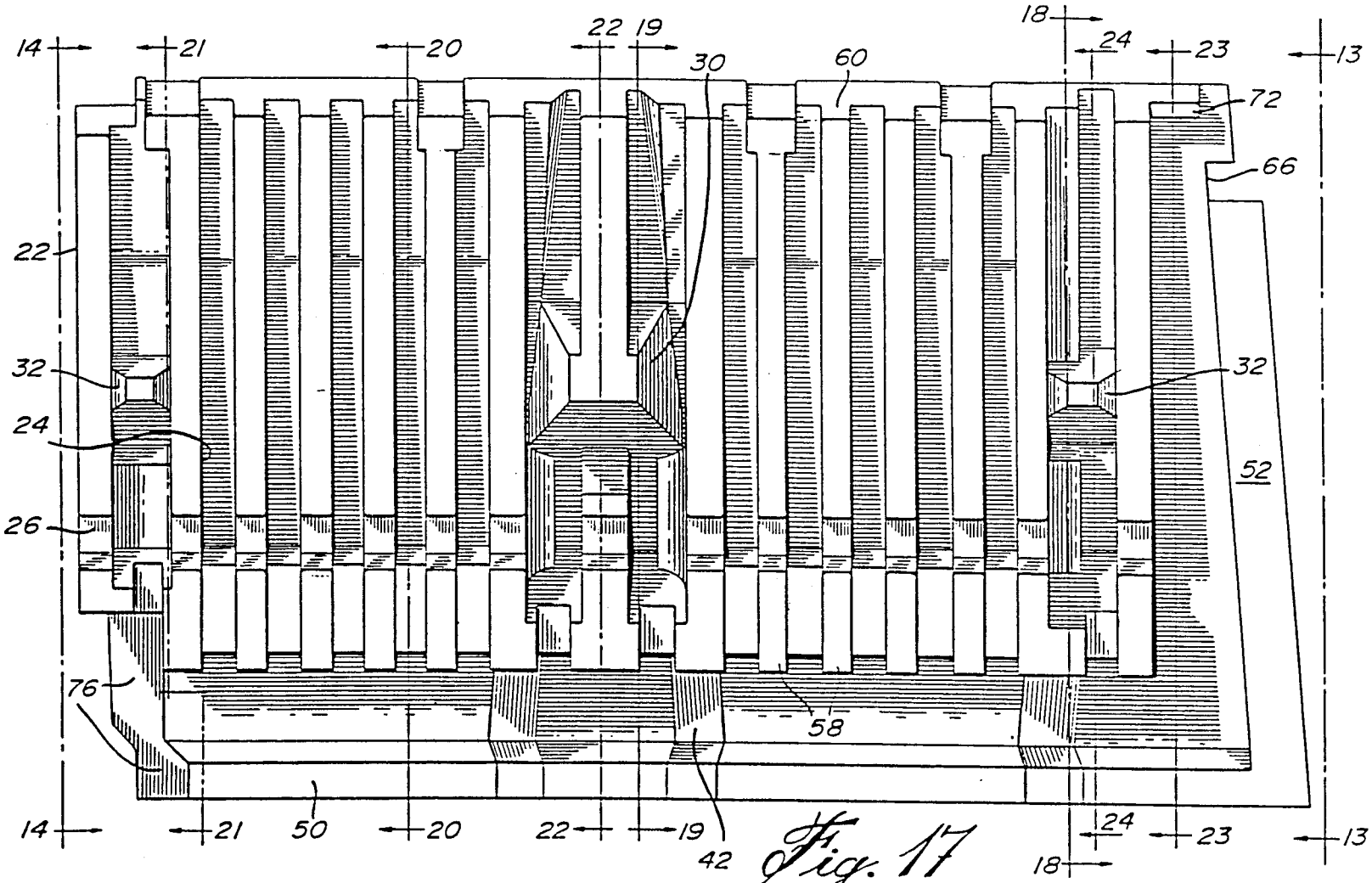
FIG. 17 is a bottom plan view of the main shingle.
Figure 18:
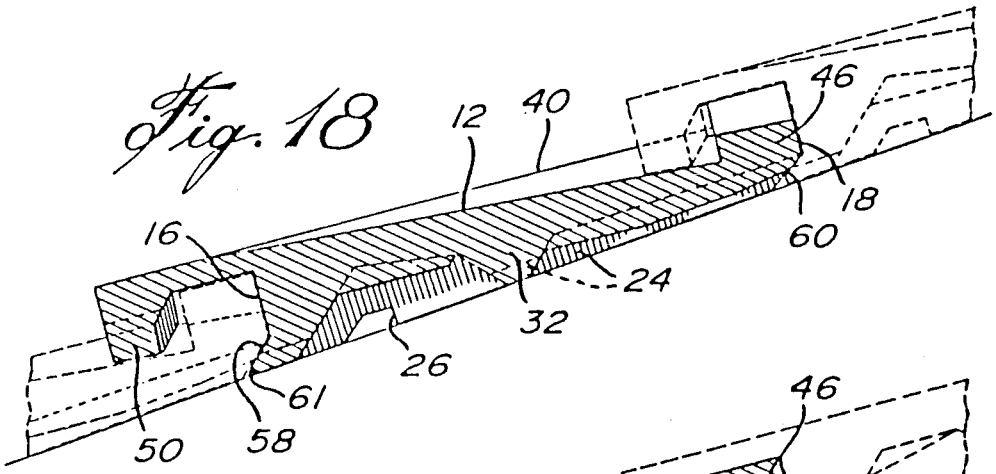
FIGS. 18 to 24 are cross-sections taken along lines 18—18, 19—19, 20—20, 21—21, 22—22, 23—23, and 24—24, respectively, of FIG. 17.
Figure 19:
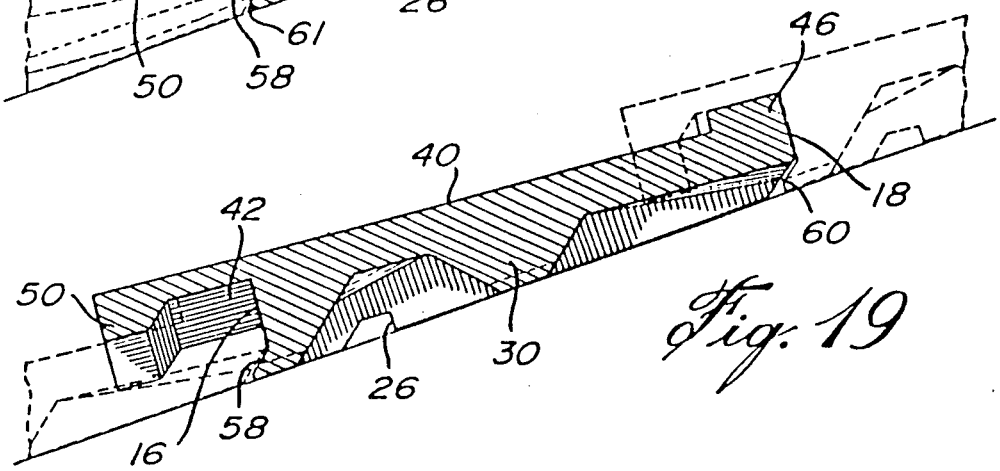

Referring to FIGS. 10 and 17, the underface 14 is provided with a network of longitudinally-extending channels 24 and with at least one cross-channel 26 intersecting the channels 24, all of these channels opening at the front and back edge faces 16, 18 and at the left-hand and right-hand side edge faces 20 and 22 of the shingle 10.

Figure 35:
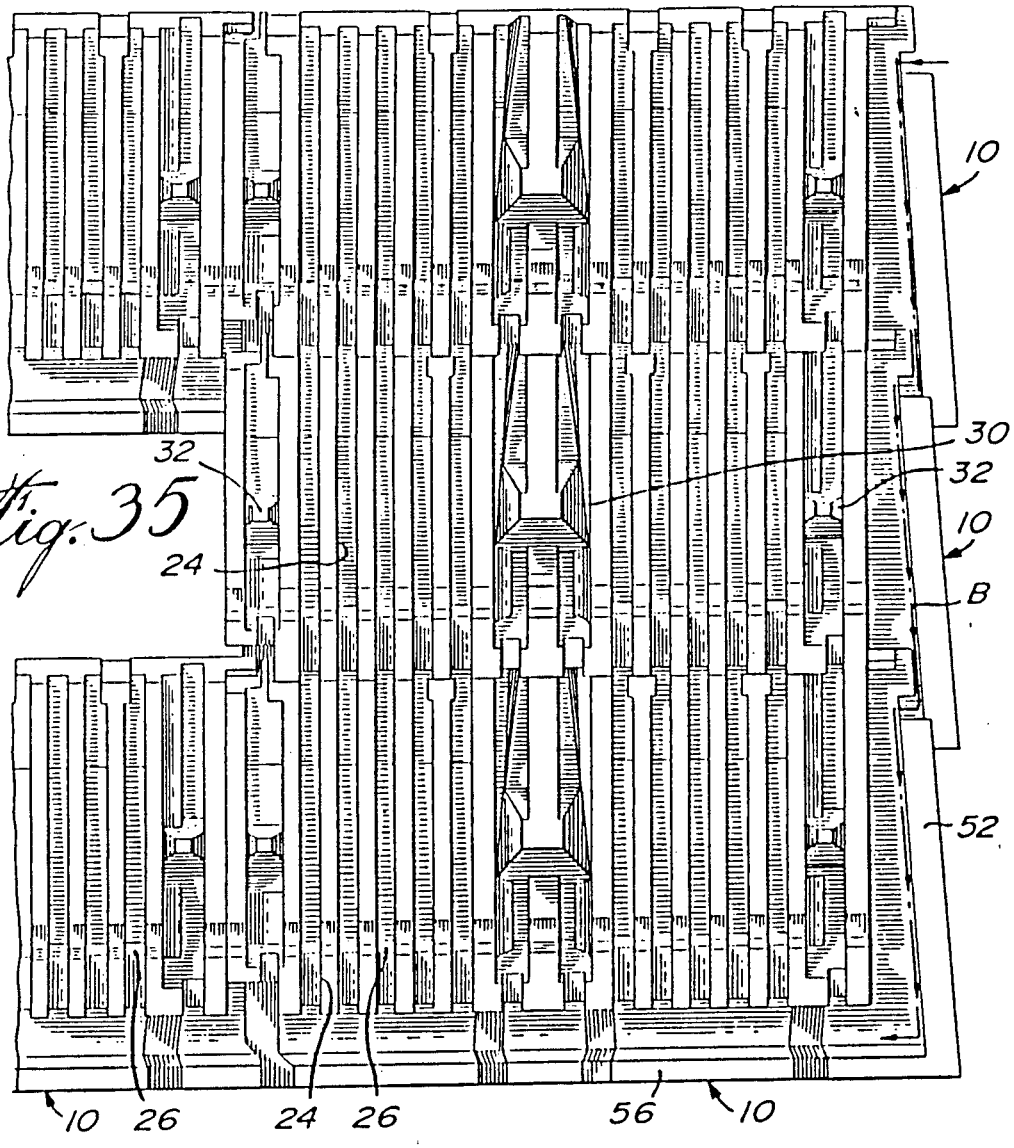
FIG. 35 is an elevation of the underface of a series of interconnected shingles.

As shown in FIG. 35, when the shingles are assembled with their edge faces in respective mutual abutment, all of the channels 24 and 26 are in mutual register or alignment, providing for the free air circulation between the underside of the assembly of shingles and the flat supporting surface 28 (see FIG. 1) on which the shingles 10 are laid. Therefore, air is free to circulate from the lower edge to the top edge of the roof, both longitudinally towards the ridge and transversely across the roof. The shingles being heat insulating, this air being in contact with the support surface 28, will not become cooled down sufficiently to create water condensation in this space and, therefore, no ice formation will be formed between the shingles and the supporting surface.

Each shingle 10 is molded in a one-piece unit and, therefore, the pyramidal formations 30 and 32, seen at the underface of the shingle (see FIGS. 10, 17 and 35), are for the purpose of facilitating shingle ejection from the mold at the end of the curing cycle.

Each shingle 10 has a front marginal extension 34, which forms a continuation of the top face 22 and which overhangs the front edge face 16. Each shingle 10 has a left-hand marginal extension 36, which also forms a left-hand extension of the top face 12 and which overhangs the left-side edge face 20 (see FIG. 10).

There are formed at top face 22 and at left-hand marginal extension 36 longitudinally-extending ribs 38, 40, respectively, each of generally trapezoidal shape when seen in cross-section, and which longitudinally tapers from front to back of the shingle 10. Rib 38 has an inclined free edge face 78 (FIG. 9). The underfaces 42 and 44 of the front marginal extension 34 and of the left-hand marginal extension 36, respectively, conform to the shape of the ribs 38, 40. Flanges 46 and 48 have a top face 46A and 48A, respectively, and an inner face 46B and 48B, respectively, upstanding from and joining with body top face 12 (FIG. 9).

As clearly shown for instance in FIGS. 18 to 21, each shingle 10 progressively decreases in thickness from front to back, that is the top face 12 and the underface 14 converge towards the back edge of the shingle. Each shingle 10 is provided along its back edge with an upstanding flange 46 and along its right-hand side with an upstanding flange 48 forming a continuation of the flange 46. Flange 46 follows the contour of the ribs 38, 40.

As shown in FIGS. 10 and 20, front marginal extension 34 is provided with a dependent flange 50, which downwardly protrudes from the underface 42. Similarly, left-hand marginal extension 36 is provided at its edge with a dependent flange 52 downwardly protruding from its underface 44 (see FIG. 10 and FIG. 15). Dependent flanges 50 and 52 have an inner face 50A FIG. 21) and 52A (FIG. 28) respectively, joining with the underfaces 42 and 44, respectively.

Figure 12:
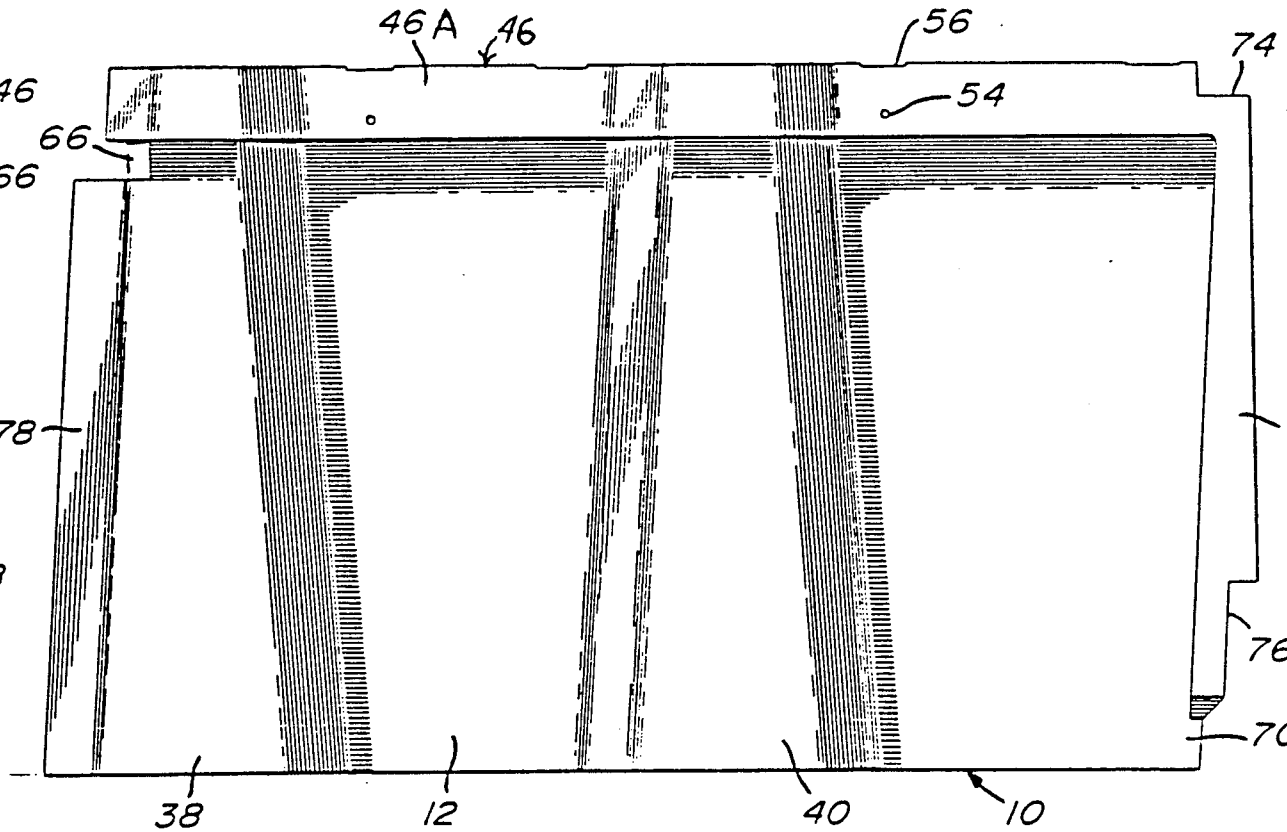
FIG. 12 is a top plan view of the main shingle.

As seen in FIG. 12, the top face 46A of upstanding flange 46 forms a nailing area at the back of the shingle 10, as shown by spaced circles 54, for the insertion of a screw to fix the shingle to the supporting surface (see FIGS. 1 and 4). Preferably, screws with washers are used and compression of the foam material produced by the screws is compensated by the back notches 56, so that the back edge face 18 of the shingle in the regions of the crews will not bulge to avoid improper interfitting of the key means described hereinafter. The underface 44 (see FIG. 15) of left-hand marginal extension 38 is generally co-planar with the top face 48A and with the top face 46A adjacent flange 48.

Key means are provided to prevent the front of each shingle from being lifted off the leading shingle of the same longitudinal row. For this purpose, as shown in FIGS. 18 to 24, front edge face 16 forms at its lower portion a forwardly-and downwardly-inclined surface portion 58 adapted to fit the rearwardly- and upwardly-inclined bevelled rear edge face portion 60 of the leading shingle of the same longitudinal row. Therefore, the front male key 58 fits with the rear female key 60. These figures also show that male key 58 has a flattened tip 61 so that, when two adjacent shingles of a longitudinal row are assembled, there is formed a cavity to receive any accumulated granules which may become dislodged when the shingles are laid on existing asphalt tiles. FIGS. 18 to 24 also show that there is formed a cross-passage 62 at the top face 12 of a leading shingle between the upstanding flange 46 of the leading shingle and the downward flange 50 of the trailing shingle. Cross-passage 62 is formed because the spacing, in a plane parallel to body top face 12, between inner face 50A of front dependent flange 50 and front face 16 is greater than the spacing, in a plane parallel to body top face 12, between the inner face 46B of back flange 46 and back edge face 18.

Figure 25:
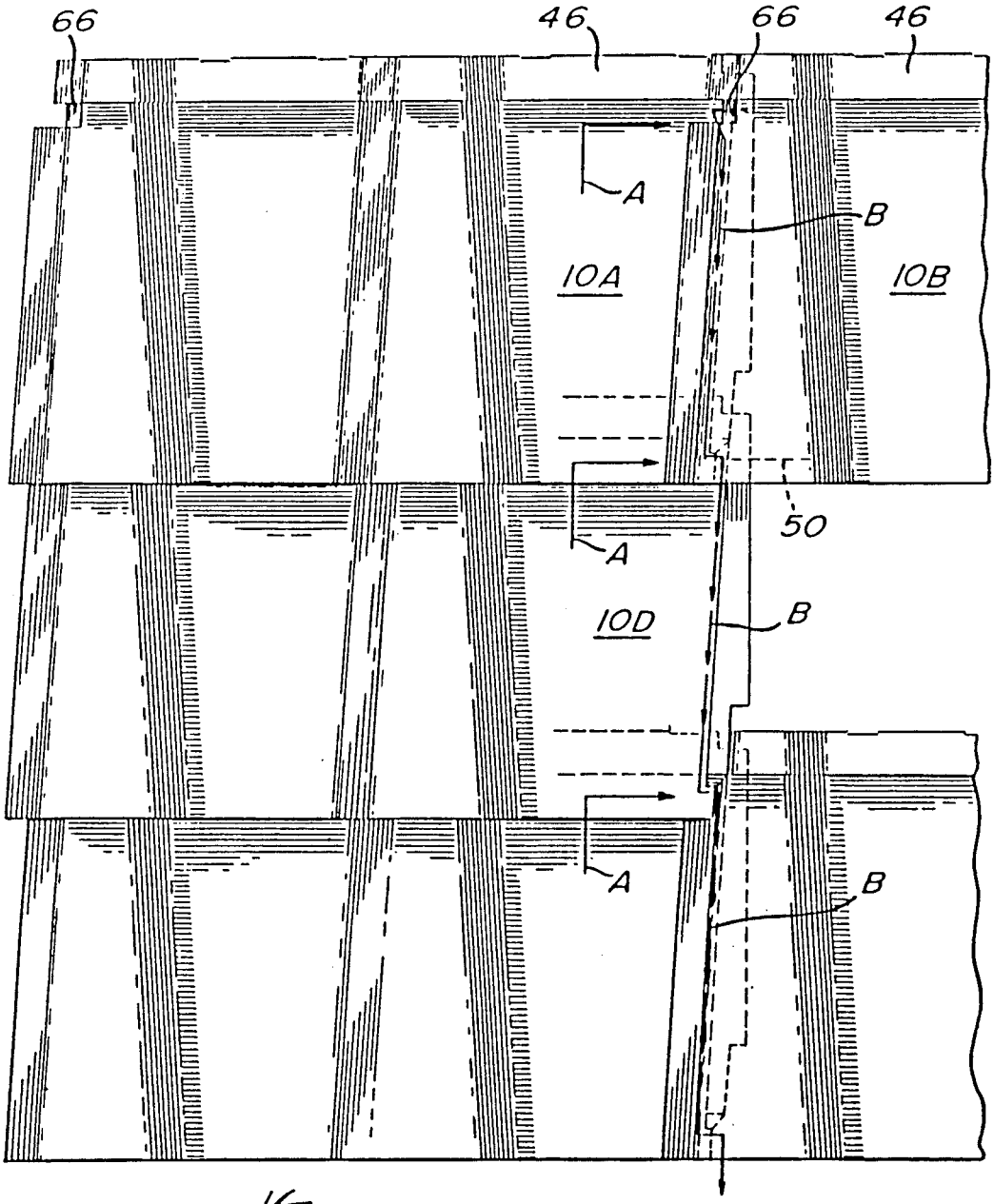
FIG. 25 is a top plan view of several main shingles disposed in longitudinal and in cross-rows, one shingle missing.
Figure 28:
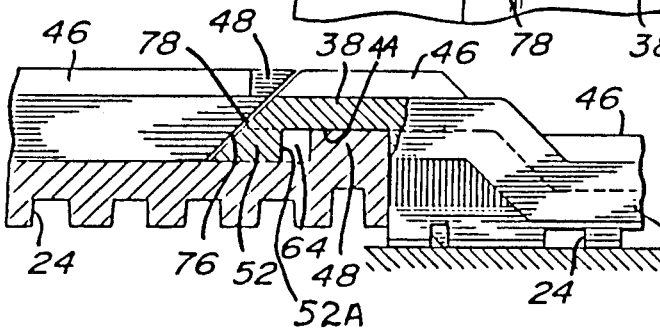
FIG. 28 is a section taken along line 28—28 of FIGS. 27 and 34.
Figure 29:
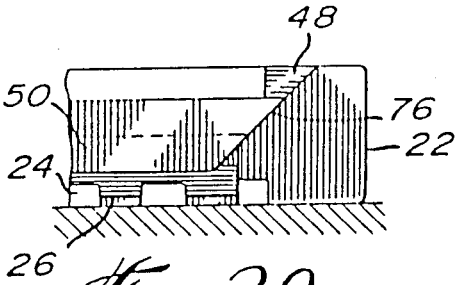
FIGS. 29 and 30 are partial front elevations, taken along lines 29—29 of FIG. 26 and 30—30 of FIGS. 26 and 34.
Figure 30:
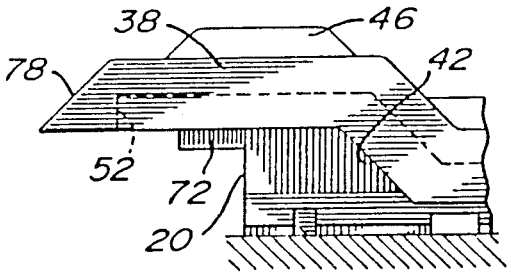
Figure 31:
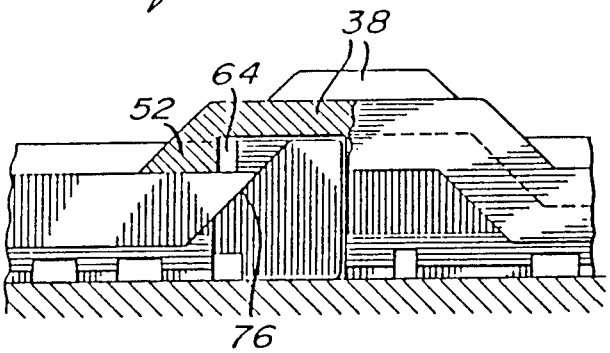
FIG. 31 is a partial section taken along line 31—31 of FIG. 27.

Similarly, as shown in FIG. 28, when two adjacent shingles 10 of the same cross-row are in abutment at their side edge faces, there is formed a longitudinal passage 64 between the upstanding right-hand flange 48 of the leading left-hand shingle and the down-flange 52 of the right-hand trailing shingle. Longitudinal passage 64 is formed because the spacing, in a plane parallel to body top face 12, between the inner face 52A of left-hand dependent flange 52 and left-hand side edge face 20, is greater than the spacing, in the plane parallel to body top face 12, between inner face 48B of flange 48 and right-hand side face 22. Obviously, the cross-passage 62 communicates with the longitudinal passage 64. Therefore, any rain pushed by the wind in the direction of the roof ridge (arrow A in FIG. 25) or in a right-hand direction, and which might enter the joint between the down-flange 50 of a trailing shingle and the top face 12 of a leading shingle of the same longitudinal row, or the joint between the down-flange 52 of a trailing shingle and the top face 12 of a leading shingle of the same cross-row, will effectively be prevented by the flanges 46, 48, which act as water barriers, from overflowing these flanges and enter the joints between the edge faces of the adjacent shingles. These passages are also effective to prevent water infiltration of the joints by capillarity between contacting faces.

Figure 26:
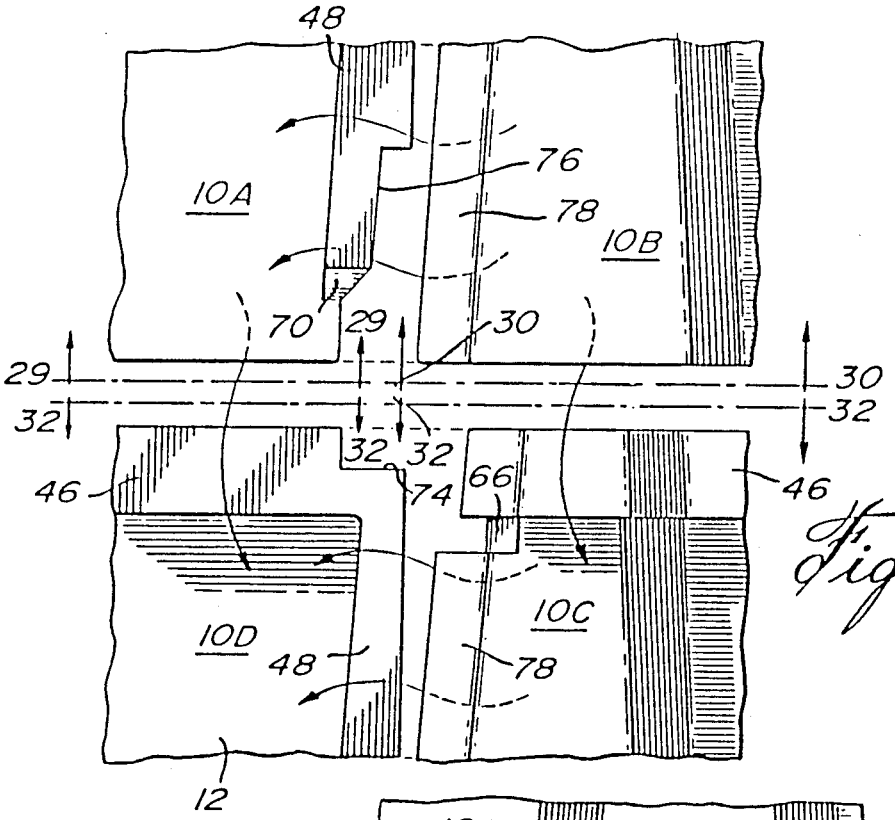
FIG. 26 is a top plan view of an array of four main shingles, each partially shown and about to be interconnected.
Figure 27:
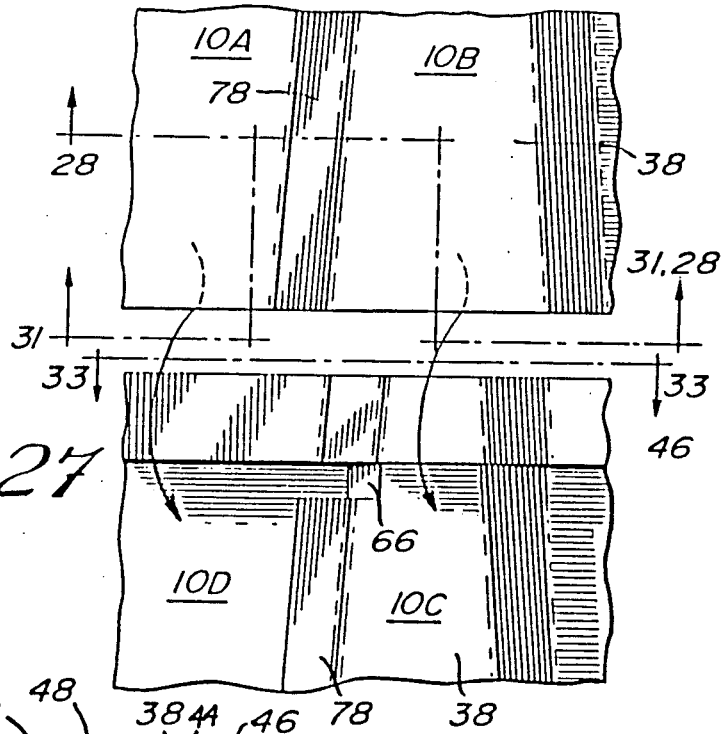
FIG. 27 is a view similar to that of FIG. 26, but with the two upper shingles interconnected and, similarly, the two lower shingles interconnected.

Moreover, the passages 62 and 64 allow any water in these passages to run off from shingle to shingle of the same longitudinal row as indicated by arrows B. For this purpose, each shingle (see FIGS. 9 and 26) is provided at its back lefthand corner with an inclined notch 66 made in the left-hand marginal extension 36 just forwardly of the upstanding flange 46. Furthermore, the front portion of the upstanding flange 48 is cut out, as shown at 70 in FIG. 9 and also in FIG. 26, so that this flange terminates short of the front edge of the front marginal extension 34.

Referring to FIGS. 25, 26, 27, and 34, it will be seen that rain water flowing down longitudinal passage 64 along shingle 10A as indicated by arrows B and which might be stopped by the overlapping down-flange 50 of the shingle 10B of the same cross-row, is free to move laterally across cutout 70, then downwardly through inclined notch 66 of diagonally located shingle 10C; then directly back into the longitudinal passage 64 of the shingle 10D, which is the leading shingle of the longitudinal row containing shingle 10A. Therefore, water runoff is allowed to take place downwardly from the concealed passages 62, 64 of the shingles of the same longitudinal row right down to the edge of the roof. It is seen that notch 66 of shingle 10C communicates the passages 64 of shingles 10A and 10D and is covered by the overlapping left-hand part of front marginal extension 34 of shingle B.

To permit easy and automatic alignment of the first cross-row of shingles 10 along the front edge of the roof, each shingle is provided at its left-hand back corner, as shown in FIG. 10, with a downwardly-protruding stop member 72, while each shingle has a cutout 74 (see FIG. 9) at its right-hand back corner, this cutout 74 being made in the back edge face 18 and right-hand side edge face 22. Therefore, several shingles of the leading cross-row are successively positioned on the support surface 22, so that the stop 72 of a trailing shingle abuts cut out 74 of a leading shingle. After alignment of three assembled shingles with the roof edge, the shingles can then be screwed in place.

The ribs 38, 40, when interfitted, provide automatic alignment of successive shingles in the same longitudinal row. The longitudinal tapering of the ribs 38, 40 is equal to the thickness of these rib walls at the front marginal extension 34, so that the front extension 34 of a trailing shingle will fit the back marginal area of the top face of the leading shingle of the same longitudinal row. For this purpose also, it is seen, as shown in FIGS. 9, 15, 29, 30 and 34 that the front right-hand corner of each shingle 10 is provided with a recessed bevelled side edge face portion 76 to accommodate and fit the downwardlyinclined free edge face 78 of the left-hand rib 38 at the back left-hand corner of the shingle 10C, which lies diagonally downward from the shingle 10A (see FIG. 34). The depth and length of recessed side edge face portion 76 is such as to permit alignment of successive shingles and overlapping of a leading shingle by a trailing shingle in the same longitudinal row.

Figure 32:
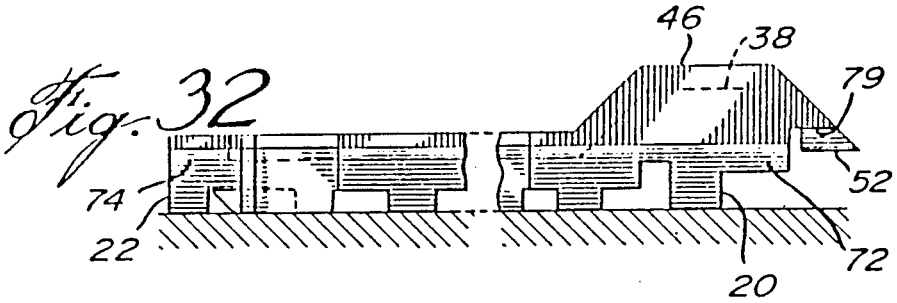
FIG. 32 is a partial back end elevation taken along lines 32—32 of FIG. 26.
Figure 33:
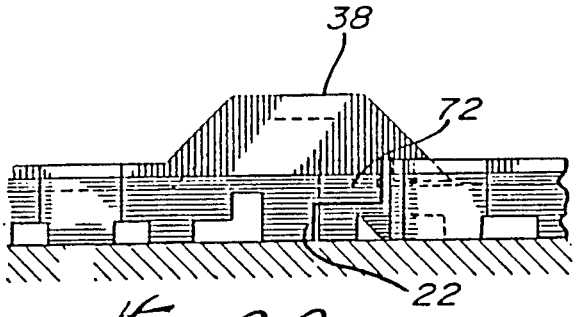
FIG. 33 is a partial back elevation, taken along line 33—33 of FIG. 27.
Figure 34:
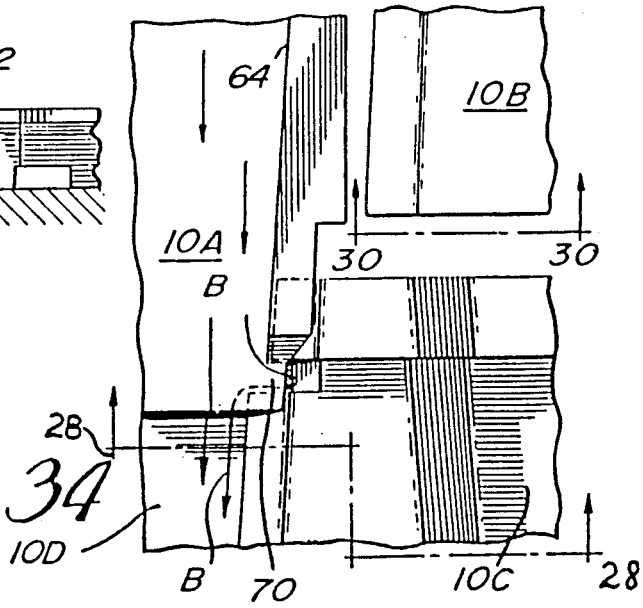
FIG. 34 is a view similar to that of FIG. 26 but showing three shingles interconnected and the remaining shingle not yet interconnected.
Figure 38:
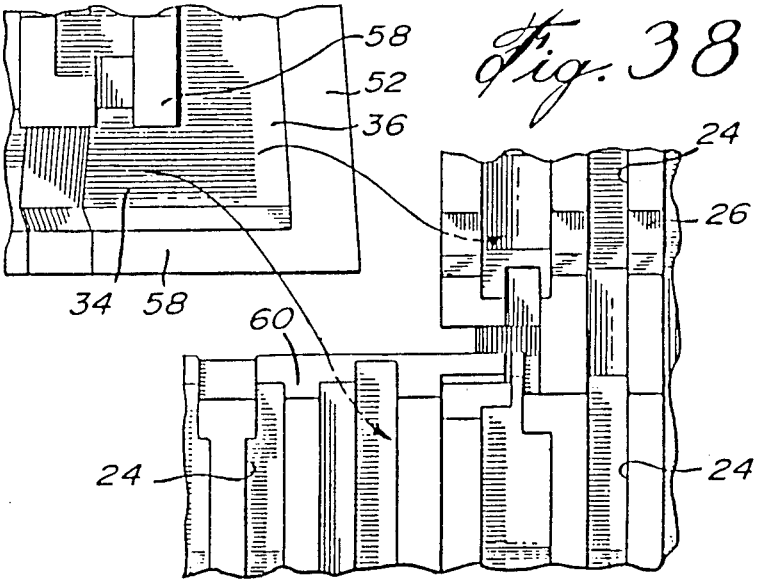

FIGS. 10 and 32 show that the back end of side downward flange 52 is cut out at 79 to accommodate the back right hand corner formed by flanges 46, 48 of the leading shingle of the same cross-row.

As shown in FIGS. 1 and 4, it is seen that the assembly of the main shingles 10 forms a covering in which the joints between the shingles is invisible and yet water run-off from the top surface of a shingle is clearly allowed within internal passages 62, 64 from one shingle to the other and from the ridge to the front lower edge of the roof.

If ice adheres to the exposed surface of the shingle, this ice cannot reach and block the internal concealed passages 62, 64 and their connection from shingle to shingle. Therefore, water is allowed to freely flow down the roof, and no water backup can be produced by the ice which would cause leakage at shingle joints.

Figure 7:
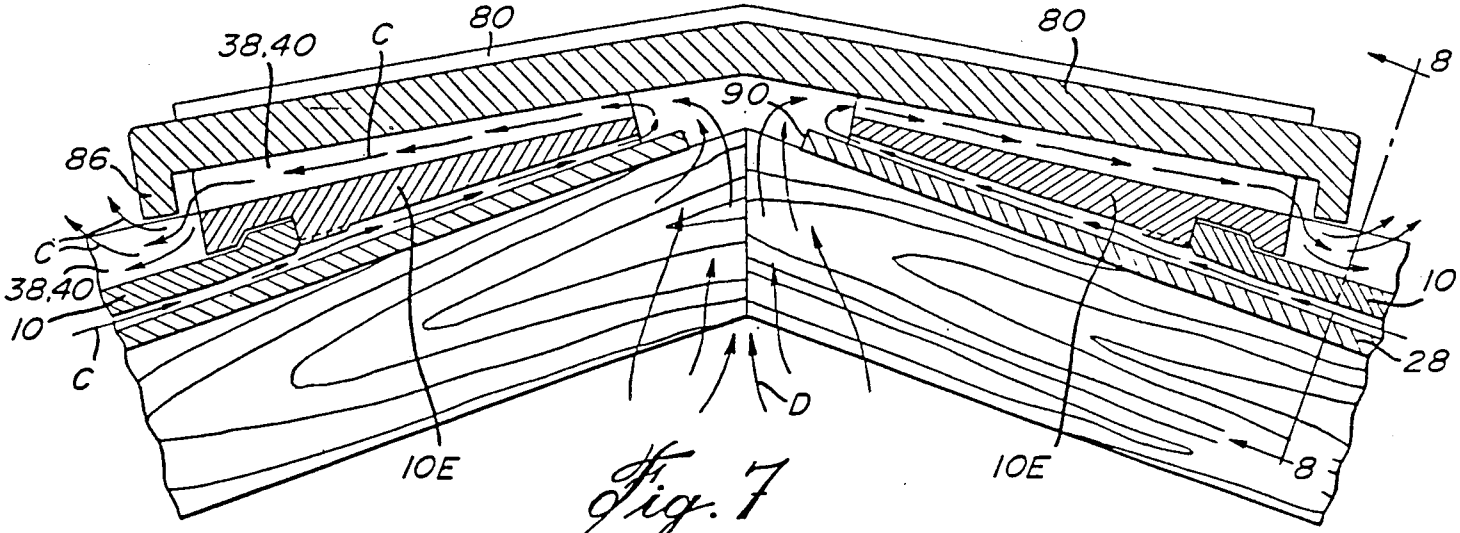
FIG. 7 is a cross-section taken along line 7—7 of FIG. 1.
Figure 8:
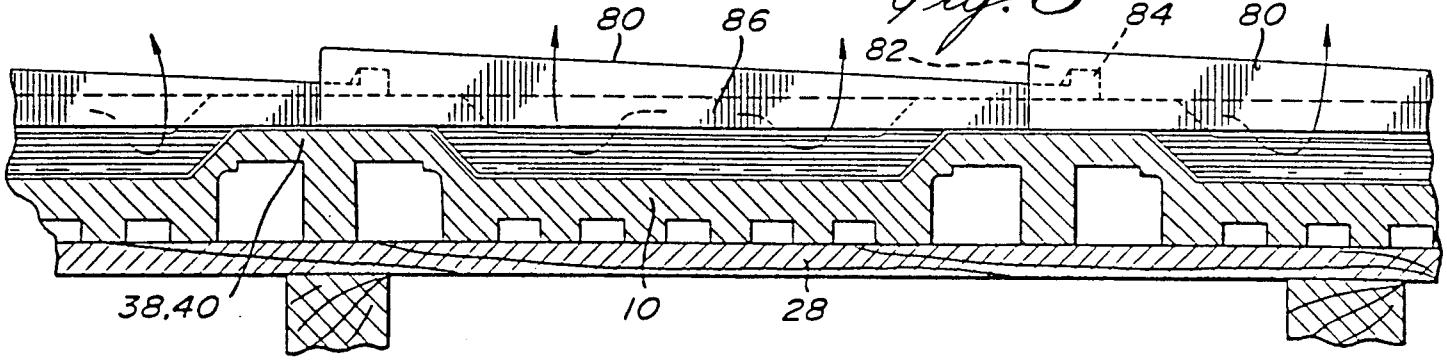
FIG. 8 is a partial section taken along 8—8 of FIG. 7.

The covering system of the invention further includes for a double-sloping roof, ridge shingles, generally indicated at 80 in FIGS. 1 and 7. Each ridge shingle 80 can also be made of heat-insulating material, such as polystyrene foam. It has an elongated shape and a generally V-shape cross-section to conform to the double slope of the roof. Each shingle has at its front edge a downward flange 82. Each shingle 80 is longitudinally tapered in thickness, as shown in FIG. 8, and is provided at its back edge with an upstanding flange 84 to cooperate with the downward flange 82 of the leading shingle 80 of the row. Each shingle 80 further has a downward side edge flange 86.

This downward flange 86 is positioned to overlap the rear marginal portions of the topmost cross-row of shingles 10, or of similar shingles 10E, the back marginal portion having been cut off in accordance with the width of the remaining portion of the roof to be covered by shingles 10E.

With this arrangement, the ventilation air flowing upwardly underneath the shingles 10 from the front of the roof to the ridge thereof, and indicated by arrows C, is allowed to escape to the atmosphere by flowing underneath the ridge shingles 80 and around downward flange 86.

Also, the air from the house attic which escapes through ridge slot 90 between the top edge of the support surface 281 is allowed to escape to the atmosphere along the passage defined by arrows D.

The downward flange 86 of the ridge shingles 80 simply rests on the ribs 38, 40 of the shingles 10 or 10E, and may be conformed to follow the contour of the top surface of the shingles 10 or 10E, while leaving a space for the escape of the ventilation air. The shingle 10 shown in FIG. 8 is not drawn to its true cross-sectional shape since this FIG. 8 is only to show how the ridge shingles 80 fit shingles 10.

The roofing system of the invention also includes side shingles, generally indicated at 92, and illustrated in FIGS. 4, 5, and 6. These shingles may also be made of heat-insulating material and molded in one piece. They are longitudinally tapered, so as to overlap each other; they have an L-shape cross-section providing a side vertical leg 94 and a top horizontal leg 96 to overlie the side of the roof and the top of an adjacent shingle 10F, that is a shingle 10 in which the left-hand side marginal extension 36 and rib 38 have been cut out.

The internal surface of the vertical leg 94 is provided with spacers 98 to form a stop for the next leading side shingle 92 and to provide an inner space 100 for ventilating air coming from the outside and flowing laterally through the crosschannels 26, made at the underfaces of the shingles 10 and 10F. Thus, ventilation under the shingles is not prevented along the sides of the roof, while the side shingles 92 provide a finish along the roof side. Mirror images of side shingles 92 are provided for the roof right hand side and the right hand side of the shingles of the last trailing longitudinal row are cut to size and shaped to fit under leg 96.

FIGS. 1 and 3 show a fascia board 102 to complete the finish of the roof and to anchor the front edge of the lowermost cross-row of shingles 10. The fascia board 102 has an L-shaped cross-section forming a top leg 104 overlying the top of the roof and downward leg 106 at the front of the eave board 108. Both legs 104 and 106 provide internal passages 110 for ventilating air C to flow through the network of channel 24, 26 of the shingles 10. Air C can also enter channels 24 through eave slot 111.

The top surface of top leg 104 is longitudinally shaped to conform to the ribs 38, 40 of the shingles 10, so as to close the openings formed at the underside of said ribs. The rear edge of leg 104 is bevelled to form a female key 112, to fit the front male key 58 of the shingles 10 of the leading cross-row. This leg 104 is also shaped to allow an internal passage 114 for the evacuation of the surface water off the lower edge of the roof into a gutter, not shown, normally provided along the lower edge of the roof.

All of the shingles in accordance with the present invention are preferably provided with a coating of a hard synthetic resin to which is admixed small rock particles, to provide a finish of any desired color, and also to reinforce the shingles, so that they can be easily walked upon.

The shingles 10 may be fixed to any kind of surface 28, either in the case of a newly-constructed home consisting of, for instance, plywood panels as illustrated in FIGS. 1, 4, 7, and 8, or they may directly be fixed to, for instance, to worn-out asphalt shingles without having to remove the latter. Therefore, the shingles of the invention can be fixed directly to any generally flat surface, even if there are irregularities on said surface.

In the description and drawings, there is described main shingles 10 which are laid from left to right in cross-rows. Obviously, shingles 10 can be modified to be laid from right to left with inter alia the left hand marginal extension of shingle 10 disposed at the right side of the modified shingle. Therefore, the terms right and left used in the claims are invertable so that the claims also read on the modified shingle.

I claim:

1. A shingle consisting of a one-piece quadrangular body, made of insulating material, having a flat underface, a body top face, a front and a back edge face substantially parallel to each other, a right-hand and a left-hand side edge face generally parallel to each other, said shingle of decreasing thickness from said front to said back edge face, said underface having intersecting channels opening at all said edge faces; a back and a right-hand peripheral flange upstanding from said body top face adjacent said back edge face and said right-hand side edge face, respectively, and interconnected at a back right-hand corner defined by the junction of said back edge face with said righthand side edge face, each peripheral flange having a top face and an inner upstanding face joining with said body top face; the top face of said back peripheral flange defining fastening areas to fasten said shingle to an underlying support surface; said front and back edge faces at least partially forwardly and downwardly inclined at substantially the same angle relative to said underface; said body top face extended by a front marginal extension of said body which overhangs said front edge face and which has an underface; said body top face extended by a lefthand side marginal extension of said body which overhangs said left-hand side edge face; said left-hand side marginal extension and the left-hand part of said front marginal extension forming a rib upstanding from said body top face and extending from the front edge of said front marginal extension to said back edge face, said rib having a free edge face, said back flange also upstanding from the rear end of said rib: the portion of said rib defining said left-hand side marginal extension and said left-hand part of said front marginal extension having an underface which is substantially co-planar with the top face of said right-hand peripheral flange and with the top face of said back peripheral flange adjacent said right-hand peripheral flange; said rib tapering from front to back of said body an amount about equal to the thickness of said left-hand part of said marginal extension, said front and left-hand marginal extensions having a front dependent flange and a left-hand dependent flange downwardly protruding from the underface of said marginal extensions, respectively, said front- and left-hand dependent flanges each having an inner face joining with the underface of said front marginal extension and with the underface of said left-hand marginal extension, respectively: the spacing, in a plane parallel to said body top face, between the inner face of said front dependent flange and said front edge face being greater than the spacing, in a plane parallel to said body top face, between the inner face of said back flange and said back edge face, the spacing, in a plane parallel to said body top face, between the inner face of said left-hand dependent flange and said left-hand side edge face being greater than the spacing, in the plane parallel to said body top face, between the inner face of said right-hand upstanding flange and said right-hand side edge face; said rib having a notch made in its free edge face adjacent and forwardly of said back flange: said right-hand peripheral flange terminating at its front end short of the front edge of said front marginal extension, the right-hand part of said front marginal extension and the front portion of said right-hand side edge face forming a recessed side edge face portion; said shingle adapted to form with three other identical shingles an array of four adjacent shingles which, when in service, have their underface flatly resting on a sloping or vertical support surface, with said front and back edge face of each shingle of said array at a substantially constant lower level and higher level, respectively, with a first lower shingle and a second upper shingle aligned in the same left-hand longitudinal row in the sloping direction, and with a third lower shingle and a fourth upper shingle aligned in the same right-hand longitudinal row in the sloping direction, with said first and third lower shingles aligned in the same lower cross-row transverse to said sloping direction and with said second and fourth shingles aligned in the same upper cross-row transverse to said sloping direction, said second and fourth shingles have their front edge face abutting and interlocking with the back edge face of said first and third shingles, respectively, and said second and fourth shingles have their front marginal extension overlapping said back flange of said first and third shingle, respectively, the left-hand edge face of said third and fourth shingles abutting the right-hand edge face of said first and second shingles, respectively, said left-hand marginal extension of said third and fourth shingles overlapping said upstanding right-hand flange of said first and second shingles, respectively, the front dependent flange of said second and fourth shingles contacting the top face of said first and third shingles, respectively, the left-hand dependent flange of said third and fourth shingles contacting the top face of said first and second shingles respectively, with the inner faces of each pair of front and back flanges and of each pair of right-hand upstanding flange and left-hand dependent flange spaced from each other to define a back concealed passage at the back of said first and third shingles, and a side concealed passage along the left-hand side of said first and second shingles, said back and side passages intercommunicating at the back right-hand corner of said first shingle and with the notch of said third shingle, the side passage along said second shingle being closed at its forward end by the front dependent flange of said fourth shingle and communicating with said notch of said third shingle around the front end of the right-hand upstanding flange of said second shingle, said last-named notch in turn communicating the side concealed passage of said first shingle and overlapped by said left-hand part of said front marginal extension; said recessed side edge face portion of said second shingle receiving the rear end portion of the free edge face of the rib of said third shingle to permit alignment of said second and first shingles in the left-hand longitudinal row and overlapping of said first shingle by said second shingle.

2. A shingle as defined in claim 1, wherein said top face is flat and said rib upstands from said top face end has an external surface which is of cross-sectionally trapezoidal shape.

3. A shingle as defined in claim 2, provided at the back lefthand corner with a stop member downwardly protruding from the underface of its left-hand marginal extension, said shingle being provided at its back right-hand corner with a notch made in said back edge face and in said right-hand corner with a notch made in said back edge face and in said right-hand side edge face, said notch adapted to receive the stop of an adjacent right-hand shingle in the same cross row to align the two shingles in said same cross row.

4. A shingle as defined in claim 2, wherein the inner face of said back upstanding flange makes a right angle with said body top face and the inner face of said front dependent flange is downwardly forwardly inclined.

5. A shingle as defined in claim 4, wherein the inner face of said right-hand upstanding flange makes a right angle with said body top face.

6. A shingle as defined in claim 3, wherein the portion of said front dependent flange, which depends from the front end of said rib, has a contour for contacting the external surface of the rear end of the rib of a lower shingle in the same longitudinal row.

* * * * *